US009084051B2

(12) United States Patent
Hudspeth et al.

(10) Patent No.: US 9,084,051 B2
(45) Date of Patent: Jul. 14, 2015

(54) UNIDIRECTIONAL MECHANICAL AMPLIFICATION IN A MICROPHONE

(75) Inventors: Albert James Hudspeth, New York, NY (US); Tobias Reichenbach, New York, NY (US)

(73) Assignee: The Rockefeller University, New York, NY (US)

( * ) Notice: Subject to any disclaimer, the term of this patent is extended or adjusted under 35 U.S.C. 154(b) by 762 days.

(21) Appl. No.: 13/362,764

(22) Filed: Jan. 31, 2012

(65) Prior Publication Data

US 2012/0213388 A1 Aug. 23, 2012

Related U.S. Application Data

(60) Provisional application No. 61/444,358, filed on Feb. 18, 2011.

(51) Int. Cl.

| | |
|---|---|
| ***H04R 3/00*** | (2006.01) |
| ***H04R 9/04*** | (2006.01) |
| ***H04R 9/08*** | (2006.01) |
| *H04R 17/02* | (2006.01) |

(52) U.S. Cl.

CPC ..... *H04R 9/045* (2013.01); *H04R 9/08* (2013.01); *H04R 3/00* (2013.01); *H04R 17/02* (2013.01)

(58) Field of Classification Search

CPC ..... H04R 17/00; H04R 17/02; H01L 41/113; G10K 9/122

USPC ..... 381/111, 114, 173, 190; 310/311, 310/313 R, 314, 322, 324, 328, 334; 367/140, 180

See application file for complete search history.

(56) References Cited

U.S. PATENT DOCUMENTS 3,334,184 A * 8/1967 De Koning ..... 381/96
3,941,932 A * 3/1976 D'Hoogh ..... 381/96

OTHER PUBLICATIONS

"Dynamic Microphones." Mediacollege.com. Feb. 27, 2010. Web. <http://www.mediacollege.com/audio/microphones/dynamic.html>.*

* cited by examiner

*Primary Examiner* — Joseph Saunders, Jr.
*Assistant Examiner* — James Mooney
(74) *Attorney, Agent, or Firm* — Foley & Lardner LLP

(57) ABSTRACT

A unidirectional active microphone that includes a diaphragm, coil, and piezoelectric component. An electrical circuit provides amplification to the coil. The piezoelectric component produces unidirectional coupling between coil and diaphragm. The microphone is unidirectional in that the amplification is provided solely to the coil and is not transferred to the diaphragm.

16 Claims, 12 Drawing Sheets

UNIDIRECTIONAL MECHANICAL AMPLIFICATION IN A MICROPHONE

CROSS-REFERENCE TO RELATED APPLICATIONS

This application claims the benefit of U.S. Provisional Application No. 61/444,358, filed Feb. 18, 2011.

STATEMENT OF FEDERAL GOVERNMENT RESEARCH SUPPORT

This invention was made with government support under grant number DC000241 awarded by the National Institutes of Health. The government has certain rights in the invention.

BACKGROUND

Amplification underlies the functioning of many biological and engineering systems. Simple electrical, optical, and mechanical amplifiers are usually reciprocal, that is the backward coupling of the output to the input equals the forward coupling of the input to the output. Unidirectional amplifiers are special non-reciprocal devices in which the output does not couple back to the input even though the forward coupling persists. Examples of unidirectional amplifiers include operational amplifiers in electrical engineering and magneto-optical devices in microwave technology. Semiconductor components are used in electrical circuits and Faraday rotation is used in optical systems to violate reciprocity and create unidirectional amplifiers. Unidirectional coupling has not been implemented, however, in a mechanical system.

Mechanical amplification can enhance the detection of a weak signal by raising its amplitude above the noise level. Biology employs this strategy in hearing: mechanosensitive hair cells in the vertebrate inner ear actively amplify weak sounds and thereby greatly lower the threshold of hearing. In contrast, microphones—the ear's technological analogue—are passive devices that do not employ mechanical amplification but rely on subsequent electronic signal processing. One difficulty in implementing mechanical amplification in microphones is the reciprocity described above, which leads to undesired feedback and hence highlights the need for a mechanism to implement unidirectional mechanical amplification.

SUMMARY

An illustrative embodiment of a unidirectional active microphone includes a piezoelectric component and a diaphragm operably coupled to a first side of the piezoelectric component. The microphone also includes a coil operably coupled to a second side of the piezoelectric component and a circuit operably coupled to the coil and the piezoelectric component. The circuit is configured to provide mechanical amplification solely to the coil.

The foregoing summary is illustrative only and is not intended to be in any way limiting. In addition to the illustrative aspects, embodiments, and features described above, further aspects, embodiments, and features will become apparent by reference to the following drawings and the Detailed Description.

BRIEF DESCRIPTION OF THE DRAWINGS

The foregoing and other features of the present disclosure will become more fully apparent from the following description and appended claims, taken in conjunction with the accompanying drawings. In the drawings, similar symbols typically identify similar components, unless context dictates otherwise. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

The present invention relates to an active unidirectional microphone utilizing mechanical amplification. The microphone is able to detect and amplify without distortion, weak signals that are not detectable by passive microphones without mechanical amplification. The active unidirectional microphone has numerous applications in, for example, sonar, sonography, and the detection of other mechanical signals such as seismic and gravitational waves.

Figure 1B:
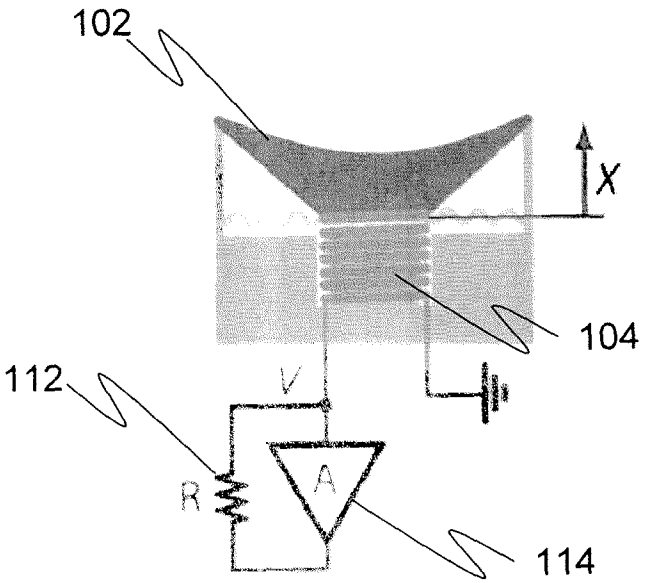
FIG. 1*b* illustrates a mechanically reciprocal active microphone.
Figure 1A:
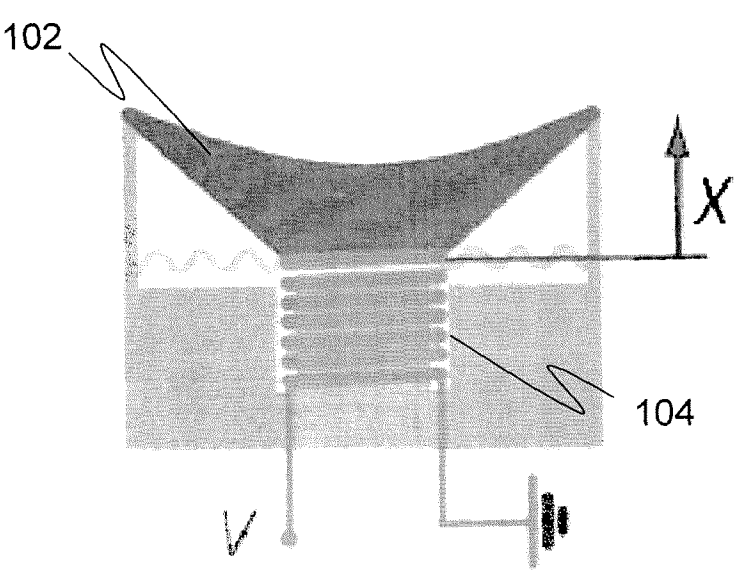
Fig. 1a Prior Art
FIG. 1*a* illustrates a conventional dynamic microphone that is mechanically passive and reciprocal.

FIG. 1*a* illustrates a conventional dynamic microphone 100 that is mechanically passive and reciprocal. A diaphragm 102 is attached to a coil 104 that moves in a magnetic field (not shown). Sound vibrates the diaphragm 102 and thereby causes oscillations of the coil 104 that electromagnetically induce a voltage. Such a system serves as a speaker when an oscillatory electrical signal is applied to the coil 104; the consequent Lorentz force vibrates the coil 104 and hence the diaphragm 102, thereby emitting sound. The system's dual function as microphone and speaker therefore results from the two forces that can act on the diaphragm 102, an external sound force $F_{ext}$ and an internal Lorentz force $F_{int}$=IlB, where I denotes the current in the coil 104, l the length of the coil 104, and B is the magnetic field. The displacement of the diaphragm 102 X can then be calculated using the formula $m\partial_t^2+\lambda\partial_2X+KX=F_{int}+F_{ext}$, in which m is the mass of the coil 104, λ is the damping coefficient of the coil 104, and K is the stiffness of the coil 104 together with the diaphragm 102 and the entrained air. The voltage V induced by the movement of the coil 104 can be calculated with the formula: $V=Bl\partial_tX$.

FIG. 1*b* illustrates a reciprocal active microphone 110. The conventional dynamic microphone 100 can be converted into the reciprocal active microphone 110 with the addition of an amplifier 114 and a resistor 112. The electrical signal from the coil 104 is amplified by the unidirectional amplifier 114, providing a gain G, and fed back into the coil through resistor 112. The amplifier's output voltage $V_A$ in response to the input voltage V is then $V_A$=GA and fulfills $V_A-V=IR$. The voltage V can be expressed in terms of the current I as $$V=\left(\frac{R}{G-1}\right)I.$$

This microphone 110 operates in a reciprocal fashion since the motion of the diaphragm 102, representing the input, is amplified by the vibration of the coil 104, which corresponds to the output.

Figure 1C:
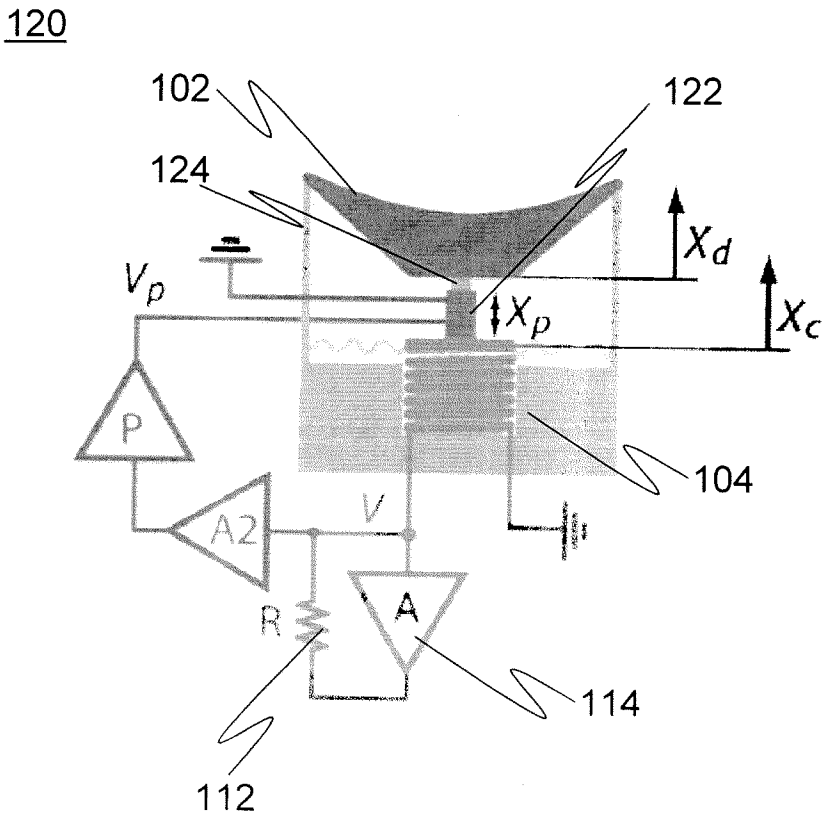
FIG. 1*c* illustrates an active unidirectional active microphone that uses mechanical amplification according to an illustrative embodiment.

FIG. 1*c* shows one illustrative embodiment of the invention in the form of a unidirectional active microphone 120 that uses mechanical amplification. Unidirectionality is achieved by placing a piezoelectric element 122, controlled by the electrical signal of the coil 104, in series with an elastic element 124 between the diaphragm 102 and the coil 104.

An input of a pure tone of frequency f into a reciprocal active microphone 110 produces an oscillatory external force $F_{ext}=\tilde{F}_{ext}e^{i\omega t}$+c.c., in which ω=2πf and c.c. denotes the complex conjugate. Because the equations are linear, the resulting displacement of the diaphragm 102 X, voltage V, and current I oscillate at the same frequency f: $X=\tilde{X}e^{i\omega t}$+c.c, $V=\tilde{V}e^{i\omega t}$+c.c, and $I=\tilde{I}e^{i\omega t}$+c.c. The amplitudes of the oscillation for each of these is given by the formuli:

$$\tilde{X}=\frac{1}{i\omega Z}\tilde{F}_{ext};$$

$$\tilde{V}=\frac{Bl}{Z}\tilde{F}_{ext};$$

and $$\tilde{I}=\frac{(G-1)Bl}{RZ}\tilde{F}_{ext}$$

where Z is the impedance and is given by the formula, $$Z=i(m\omega-K/\omega)+\lambda-l^2B^2(G-1)/R.$$

Based upon the equation for impedance above, a resonant frequency $$\omega_0=2\pi f_0=\sqrt{\frac{K}{m}}.$$

Figure 2B:
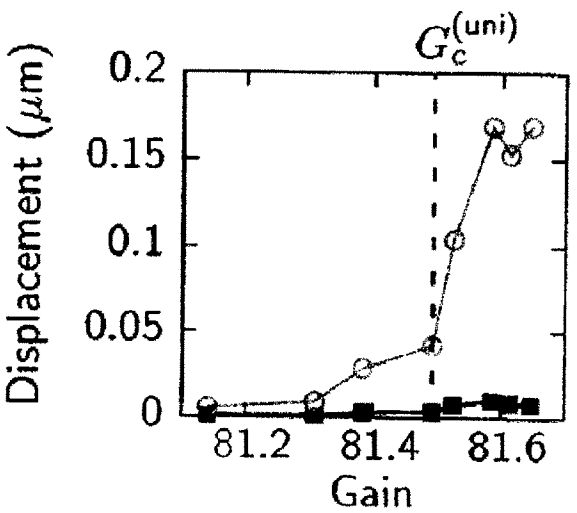
FIGS. 2*a* and 2*b*, respectively, illustrate supercritical Hopf bifurcations in a reciprocal active microphone and a unidirectional active microphone in accordance with an illustrative embodiment.
Figure 2A:
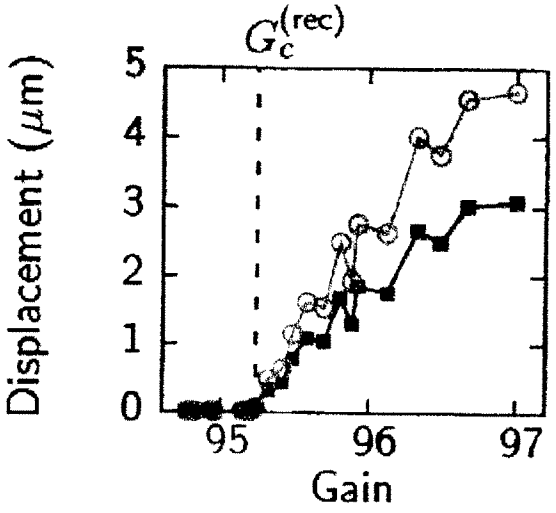

At the resonant frequency the imaginary part of the impedance vanishes. The real part of the impedance results from damping λ counteracted by the positive feedback. The real part of the impedance vanishes at a critical value of the gain $G_c=1+\lambda R/(l^2B^2)$. The critical gain value defines a transition from damped to undamped oscillation. Nonlinearities control the system's behavior at this bifurcation and yield a transition from damped to stable limit-cycle oscillations consistent with a supercritical Hopf bifurcation. FIGS. 2*a* and 2*b* illustrate supercritical Hopf bifurcations in the reciprocal active microphone 110 and the unidirectional active microphone 120, respectively. Squares represent the displacement of the diaphragm 102 and circles the displacement of the coil 104. The reciprocal active microphone 110 exhibits a supercritical Hopf bifurcation at a critical gain of 95.2 in the amplifier 114, while the unidirectional active microphone 120 exhibits one at a critical gain of 81.5 in the amplifier 114. In the absence of an external stimulus, and apart from noise, the system is quiescent below the critical gain. For gains exceeding the critical gain, spontaneous limit-cycle coil oscillations emerge. The displacement of the diaphragm 102 reflects the Hopf bifurcation in the reciprocal active microphone 110 but not in the unidirectional active microphone 120. Illustrative of the unidirectional behavior of the unidirectional active microphone 120, the displacement of the diaphragm 102 is much smaller compared to the displacement of the coil 104.

A system operating near a Hopf bifurcation can be described by the normal form:

$$\partial_t z=(a+i\omega_0)z+(b+ic)|z|o(z^3)$$

Here z is a complex variable that, in the case of an active microphone, can encode the displacement of the coil 104 X and velocity $\partial_tX$. The resonant frequency is given by $\omega_0$ and a, b, c are real coefficients with a=0 representing the Hopf bifurcation. The linear part of above nominal form equation can be derived from the equations above regarding the displacement of diaphragm 102, the voltage induced by the coil 104, and the voltage in terms of the current. The nonlinear part results from nonlinear forces in the system. Although those forces may have different quadratic and cubic (as well as higher-order) contributions in the variables X and $\partial_tX$, a nonlinear transformation to the z-variable exists such that z agrees with X, $\partial_tX$. to linear order, such that the quadratic nonlinearities disappear, and such that the cubic nonlinearities take the form $|z|^2z$. Higher-order nonlinearities can be cast into the U(1)-symmetric forms $|z|^4z$, $|z|^6z$ and so on.

When the normal form is periodically forced by $\tilde{f}e^{iw_0t}$ at the resonant frequency and at the Hopf bifurcation (a=0) and when the resulting displacement is small such that nonlinearitics higher than the cubic can be ignored, the Fourier component $\tilde{z}$ at $\omega_0$ obeys:

$$0=(b+ic)|\tilde{z}|^2\tilde{z}+\tilde{f}$$

and thus exhibits a nonlinear response:

$$|\tilde{z}\sim|\tilde{f}|^{1/3}$$

with a power-law exponent of ⅓. In an experimental active microphone the nonlinear response was measured to be around ½, instead of ⅓. Magnetic saturation of the coil 104 may explain this difference.

Figure 3A:
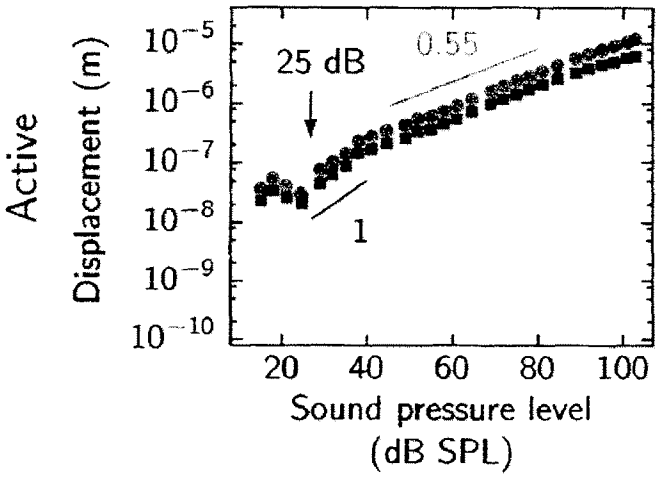
FIGS. 3*a* and 3*b*, respectively, illustrate coil and diaphragm displacement as functions of sound-pressure level for a reciprocal active microphone and a unidirectional active microphone according to an illustrative embodiment, respectively.
Figure 3B:
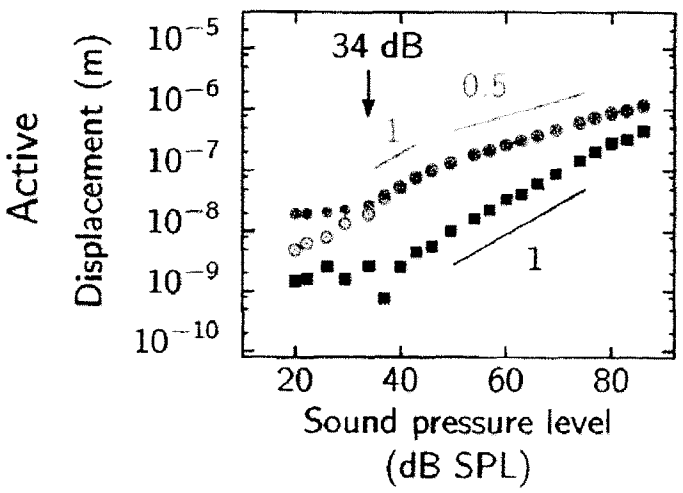

FIGS. 3*a* and 3*b* illustrate the displacement of the diaphragm 102 and the coil 104 as functions of the sound-pressure level for the reciprocal active microphone 110 and the unidirectional active microphone 120 according to an illustrative embodiment, respectively. The unidirectional active microphone 120 is described in detail below. The microphones 110 and 120 are stimulated at their resonant frequencies, which may be different based upon the characteristics of the microphones 110 and 120. The displacement of the diaphragm 102 is indicated by the squares and the displacement of the coil 104 is indicated by the circles. The diaphragm's displacement can be measured from interferometric measurements, and the Fourier component is used in FIGS. 3*a* and 3*b*. The coil's displacement can be inferred from the coil's voltage. Open circles represent the Fourier component and the full circles illustrate the root-mean-square value multiplied by $\sqrt{2}$. The displacement of the diaphragm 102 differs between the reciprocal active microphone 110 and the unidirectional active microphone 120, because the displacement of the diaphragm 102 is amplified and hence nonlinear in the reciprocal active microphone 110, but is not amplified and therefore linear in the unidirectional active microphone 120.

Figure 2D:
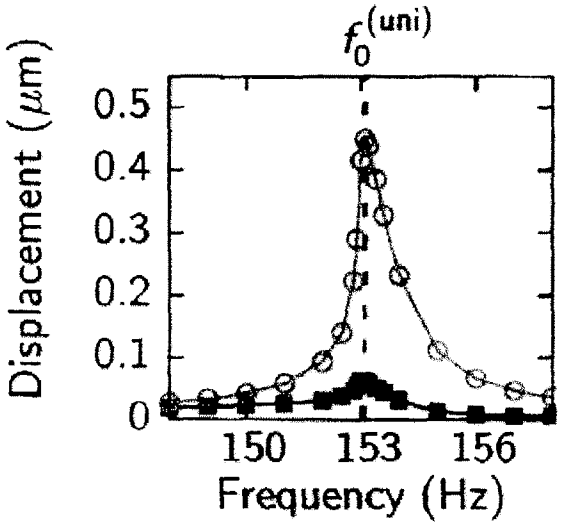
FIGS. 2*c* and 2*d* illustrate coil and diaphragm displacement near a resonant frequency in a reciprocal active microphone and a unidirectional active microphone in accordance with an illustrative embodiment.
Figure 2C:
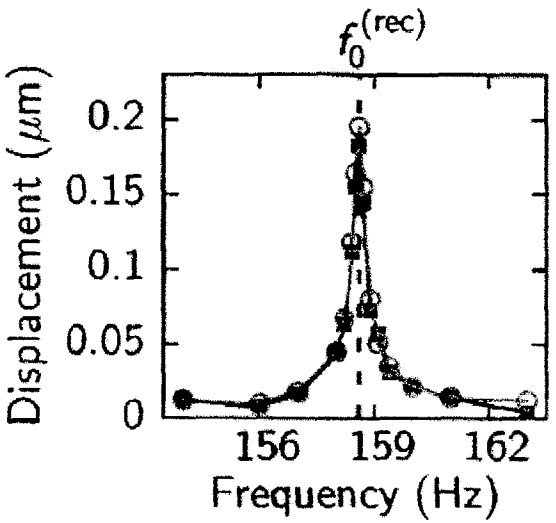

Returning to a system operating near a Hopf bifurcation, such a system enhances the detection of sounds at the resonant frequency $f_0$. The active microphone's response is sharply tuned to the resonant frequency at which the linear part of the response vanishes and the response becomes nonlinear. FIG. 2*c* illustrates this for a reciprocal active microphone 110. Both the displacement of the diaphragm 102 and the coil 104 peak at the resonant frequency of an 158.6 Hz. The same behavior holds for a unidirectional active microphone 120 as illustrated in FIG. 2*d*. As evidence of the microphone's unidirectional behavior, the coil displacement peaks sharply at the resonant frequency, 153.1 Hz, however, the diaphragm's displacement is significantly smaller.

Amplification acts only on the noise component at the resonant frequency and not on the remaining noise spectrum, and thus improves the signal-to-noise ratio and lowers the threshold for signal detection at the resonance. Because an illustrative microphone detects only a small band of frequencies near its resonance, an ensemble of microphones tuned to different resonant frequencies can be used to cover a broader frequency range. The signals from the various microphones can be combined using techniques known to those of skill in the art to provide a variety of commercial products.

Figure 3D:
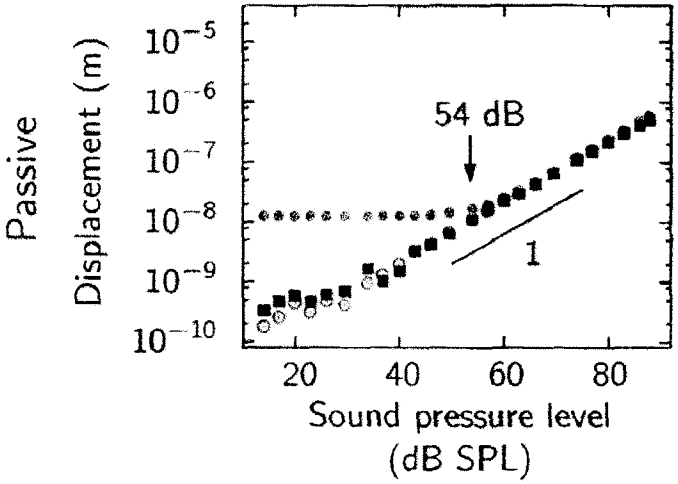
FIGS. 3*c* and 3*d* illustrate the displacement of the diaphragm 102 and the coil 104 as functions of the sound-pressure level for a reciprocal passive microphone and a unidirectional passive, respectively.
Figure 3C:
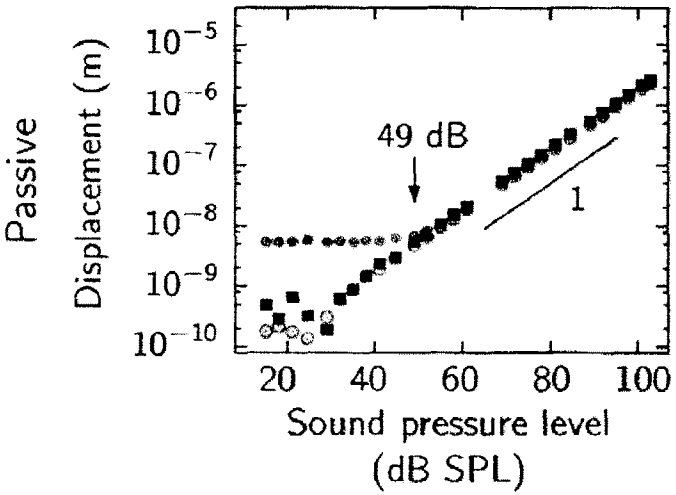

Compared to passive microphones, illustrative active microphones are able to detect fainter signals compared to passive microphones. FIGS. 3*c* and 3*d* illustrate the displacement of the diaphragm 102 and the coil 104 as functions of the sound-pressure level for a reciprocal passive microphone (not shown) and a unidirectional passive microphone (not shown), respectively. The microphones are stimulated at the resonant frequencies of the counterpart active microphone. The displacement of the diaphragm 102 is indicated by the squares and the displacement of the coil 104 is indicated by the circles. The diaphragm's displacement can be measured from interferometric measurement, and the Fourier component is used in FIGS. 3*c* and 3*d*. The coil's displacement can be inferred from the coil's voltage. Open circles represent the Fourier component and the full circles illustrate the root-meant-square value multiplied by $\sqrt{2}$. The root-mean-square displacement of the coil 104 becomes a constant at the noise floor. Sound-pressure levels that exceed the noise floor denotes the threshold for sound detection and is indicated in FIGS. 3*a*-3*d* by arrows. FIGS. 3*a*-3*d* illustrate the active microphones 110 and 120 with signal detection thresholds that are significantly lower than their counter-part passive microphones. Because the piezoelectrical coupling introduces additional noise, the signal-detection thresholds in the passive microphone and the unidirectional active microphone 120, as illustrated in FIGS. 3*b* and 3*d*, are slightly increased compared to their reciprocal analogues, FIGS. 3*a* and 3*c*.

Turning to the unidirectional active microphone 120, the length of the piezoelectric element 122 is variable. The change in the length of the piezoelectric element 122, $\tilde{X}_p$, is controlled by the voltage of the coil 104 and is proportional to the displacement of the coil 104, $X_c$, by the formula, $\tilde{X}_p=-\alpha\tilde{X}_c$, with a complex coefficient determined by the electrical circuit that feeds a voltage back into the coil 104.

The displacement of the diaphragm 102, $\tilde{X}_d$, and the coil 104, $\tilde{X}_c$, caused by an external sound force can be calculated by the formulas:

$$i\omega A\begin{pmatrix}\tilde{X}_d\\ \tilde{X}_c\end{pmatrix}=\begin{pmatrix}\tilde{F}_{int}\\ \tilde{F}_{ext}\end{pmatrix}.$$

with the matrix $$A=\begin{pmatrix}Z_d+Z & -(1+\alpha)Z\\ -Z & Z_c+(1+\alpha)Z\end{pmatrix}.$$

In the above equation, $Z_d$ denotes the impedance of the diaphragm 102, $Z_c$ the impedance of the coil 104, and Z the impedance of the elastic element 124.

The piezoelectric element 122 and the elastic element 124 break reciprocity when $a\neq 0$ and the coupling of the coil 104 to the diaphragm 102, given by the matrix element $A_{12}$, differs from the coupling of the diaphragm 102 to the coil 104, represented by $A_{21}$. At a critical value $\alpha_*=-1$ the coupling becomes unidirectional, the matrix element $A_{12}$ vanishes and thus, the coupling vanishes from the coil 104 to the diaphragm 102, whereas $A_{21}$ remains nonzero; and thus the coupling from the diaphragm 102 to the coil 104 remains nonzero. The setting of the coefficient $\alpha$ to its critical value $\alpha_*$ requires adjustment of both its amplitude and phase, which can be achieved through amplifying and subsequently phase-shifting the coil voltage.

At the critical value $\alpha_*$ the displacements are:

$$\tilde{X}_d=\frac{1}{i\omega(Z_d+Z)}\tilde{F}_{ext}\text{ and }\tilde{X}_c=\frac{Z}{i\omega Z_c(Z_d+Z)}\tilde{F}_{ext}+\frac{1}{i\omega Z_c}\tilde{F}_{int}.$$

Unidirectional coupling is manifest in these equations because the coil 104 is displaced both by the external sound force and by the internal Lorentz force, whereas only the sound force acts on the diaphragm.

Figure 4B:
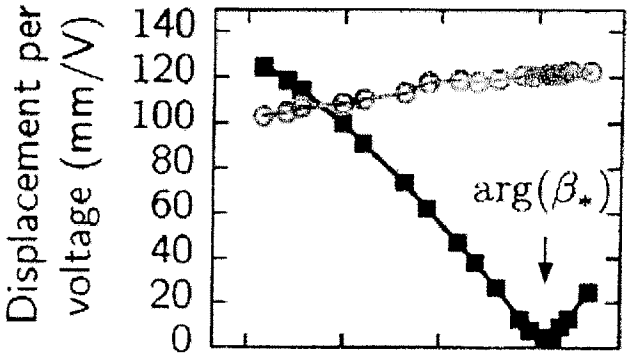
FIGS. 4*a*-4*d* illustrate the emergence of unidirectionality in relation to ratio β of a piezoelectric element voltage to the coil voltage according to an illustrative embodiment.
Figure 4A:
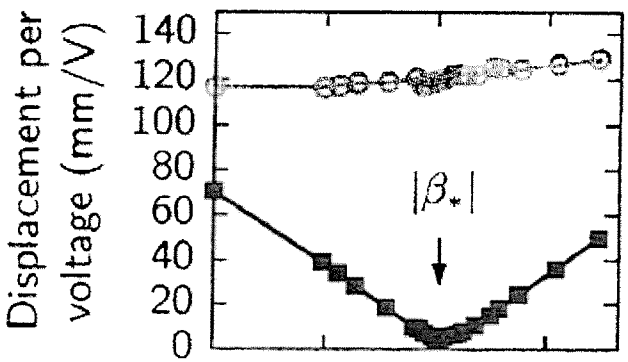
Figure 4D:
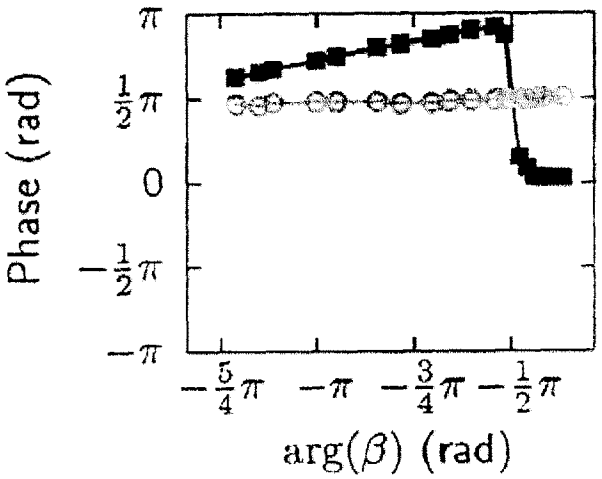
Figure 4C:
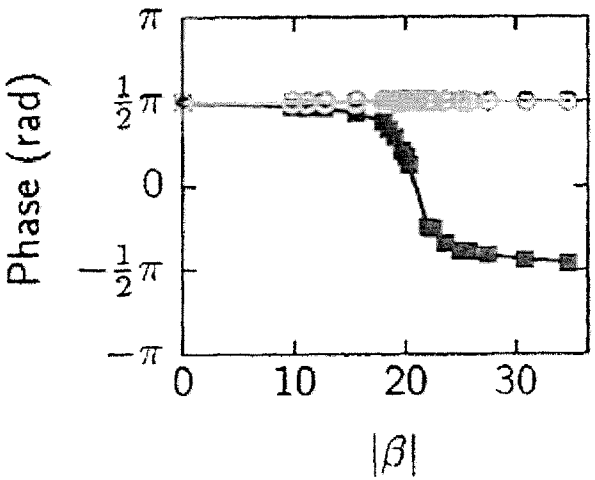

FIGS. 4*a*-4*d* illustrate the emergence of unidirectionality in relation to ratio $\beta$ of the piezoelectric element 122 voltage to the coil 104 voltage, $\beta\equiv\tilde{V}_p/\tilde{V}$, which relates linearly to coefficient $\alpha$, when $\beta$ is tuned to a critical value $\beta_*$ of the correct amplitude and phase. FIGS. 4*a* and 4*b* illustrate the displacement of the diaphragm 102 per coil voltage, $\tilde{X}_d/\tilde{V}$, with squares and the displacement of the coil 104 per coil voltage, $\tilde{X}_c/\tilde{V}$, with circles, that result when the coil 104, but not the diaphragm 102, is stimulated. FIGS. 4*c* and 4*d* illustrate the amplitude and phase of the displacement of the diaphragm 102 and coil 104, again with squares and circles, respectively, per voltage when the phase of $\beta$ is varied and its magnitude held constant at the critical value $|\beta_*|$. As seen in FIGS. 4*a*-4*c*, the displacement of the coil 104 is largely independent of β. The diaphragm's displacement, however, almost vanishes at $\beta_*$, which illustrates undirectionality as the forces on the coil 104 are not transmitted to the diaphragm 102. FIGS. 4*b* and 4*d* also show the diaphragm displacement undergoes a phase change of π around $\beta_*$. The displacement of the diaphragm 102 does not vanish completely at $\beta_*$ because of nonlinearities in the piezoelectric element 122 and noise.

Because amplification in the unidirectional active microphone 120 acts through the internal Lorentz force on the coil 104, but not on the diaphragm 102, the coil's displacement exhibits a Hopf bifurcation at a critical gain whereas the motion of the diaphragm 102 does not. This behavior is illustrated in FIG. 2*b*, where the displacement of the diaphragm 102, represented by black squares, does not exhibit non-linear behavior at gains greater than the critical gain. The system's response at the Hopf bifurcation reflects this difference as the linear response of the coil 104 vanishes at the bifurcation, and the coil 104 exhibits nonlinear behavior. In FIG. 3*b*, this is illustrated by the circles, representing the displacement of the coil 104. The diaphragm 102, however, does not exhibit nonlinear behavior as indicated by the black squares. Rather, the displacement of the diaphragm 102 is linear.

One benefit of unidirectionality in the unidirectional active microphone 120 is a lower critical gain compared to a reciprocal active microphone 110. FIGS. 2*a* and 2*b* illustrate this, as the unidirectional active microphone 120 has a critical gain near 81.5 compared to the 95.2 gain of the reciprocal active microphone 110. The lower critical gain is due to the fact that amplification of the diaphragm 102 requires energy that is spared with unidirectional coupling. The critical gain of the amplifier at which the Hopf bifurcation emerges is therefore lower in the unidirectional active microphone 120 than in the reciprocal active microphone 110.

Another important advantage of the invention is prevention of distortion. FIGS. 5*a*-5*f*, which are described in further detail below, illustrate this advantage of the unidirectional active microphone 120. The nonlinear response of an active microphone near its Hopf bifurcation causes the formation of distortion products. For example, when stimulated at two frequencies $f_1$ and $f_2$ an active microphone also responds to linear combinations of these frequencies such as $2f_1-f_2$ and $2f_2-f_1$. A strong response results if one distortion product coincides with the microphone's resonant frequency $f_0$. When amplification is reciprocal, such as in the reciprocal active microphone 110, this distortion product is emitted because the coil 104 transmits the distortion to the diaphragm 102, (see FIG. 5*c*), and a sound results, (see FIG. 5*e*). A unidirectional active microphone 120, in contrast, prevents the emission of such a distortion product. Although the distortion product appears in the coil's voltage, (see FIG. 5*b*), and displacement owing to the coil's operation near a Hopf bifurcation, the distortion product is not transmitted to the diaphragm 102, (see FIG. 5*d*), and is therefore not emitted as sound, (see FIG. 5*f*).

An ensemble of distortion products results when amplification is reciprocal. The number and frequency of distortion products to which an active microphone responds are determined by the form of the nonlinearities that dominate near the bifurcation. For example, the normal form the Hopf bifurcation induces only the cubic distortion products $2f_1-f_2$ and $2f_2-f_1$ in response to stimulation at $f_1$ and $f_2$. However, as described above, detection of signals within a certain frequency range requires an array of active microphones with distinct resonances covering that range. When $f_1$ and $f_2$ are presented to such an array of the reciprocal active microphones 110, a cascade of combination tones results. Indeed, the distortion products at $2f_1-f_2$ and $2f_2-f_1$ will be emitted by the microphones 110 tuned to these frequencies and interact with the stimuli at frequencies $f_1$ and $f_2$ as well as themselves to create other distortion products such as $3f_1-f_2$ and $3f_2-f_1$. Those will again be emitted and interact with the present tones to create yet additional frequencies, and so on. An ensemble of frequencies $f_1 \pm n(f_2-f_1)$, $n \in N$, forms the amplitude of which decays exponentially with increasing n. Such cascades of distortion products have been recorded from the high-frequency region of the mammalian inner ear, where amplification is reciprocal.

Unidirectional coupling prevents the cascade of distortion products. Although distortion products such as $2f_1-f_2$ and $2f_2-f_1$ are formed in the coil 104, they are not emitted, such as to the diaphragm 102, and hence do not create further distortion products. The resulting reduction in the number of distortion products represents a significant advantage of the unidirectional active microphone 120 over its reciprocal counterpart.

Figure 5A:
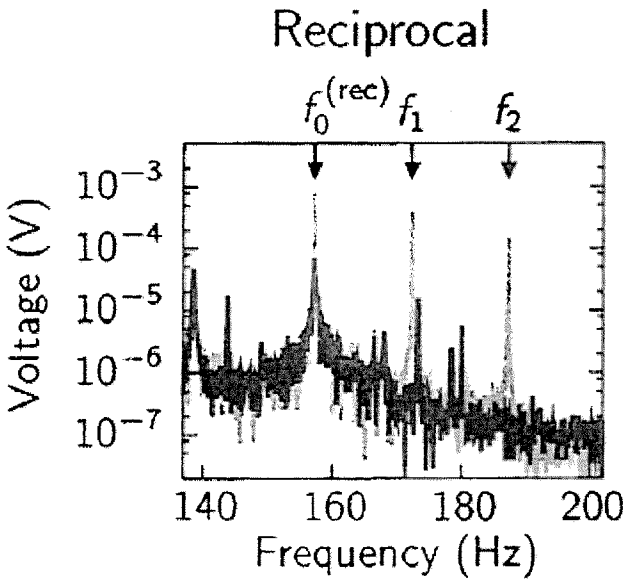
FIGS. 5*a*, 5*c*, and 5*e* illustrate distortion in a reciprocal active microphone.
Figure 5B:
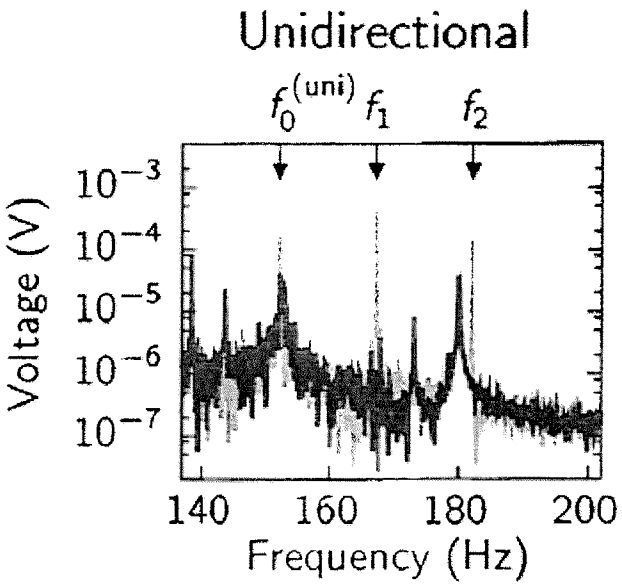
FIGS. 5*b*, 5*d*, and 5*f* illustrate the lack of the distortion in an unidirectional active microphone according to an illustrative embodiment.
Figure 5C:
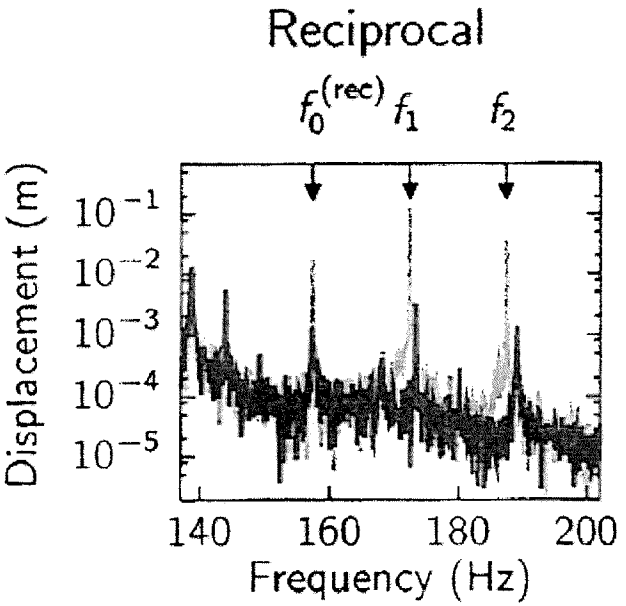
Figure 5D:
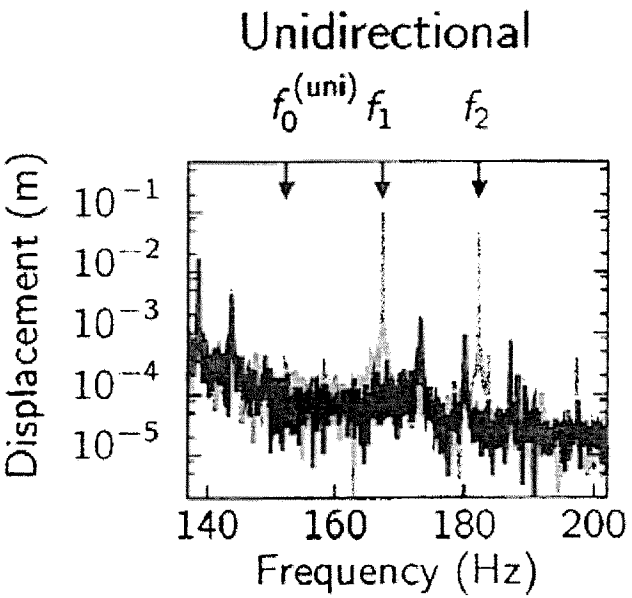
Figure 5F:
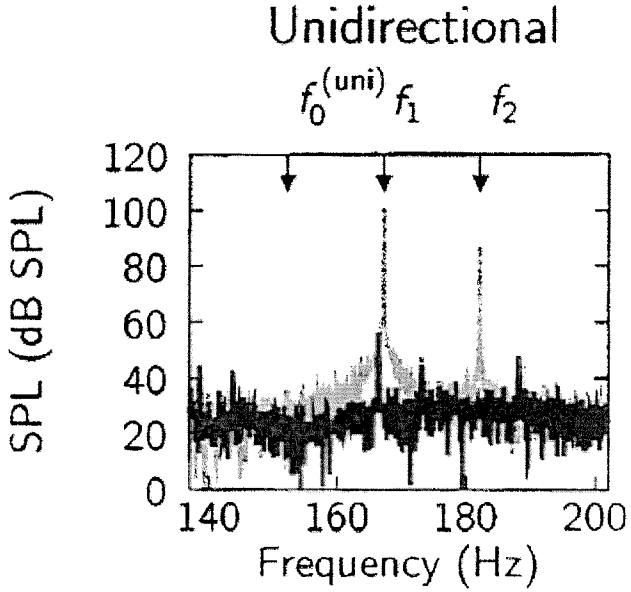
Figure 5E:
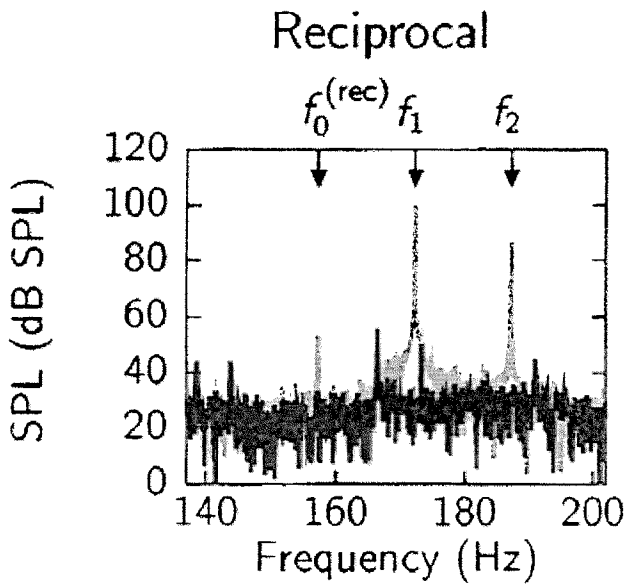

As referenced above, FIGS. 5*a*, 5*c*, and 5*e* illustrate distortion in a reciprocal active microphone 110, while FIGS. 5*b*, 5*d*, and 5*f* shows the lack of the distortion in a unidirectional active microphone 120. To illustrate the differences in distortion, the reciprocal active microphone 110 and unidirectional active microphone 120 were stimulated with two frequencies $f_1$ and $f_2$, such that $2f_1-f_2$ matches the resonant frequencies $f_0$ of the microphones 110 and 120. FIGS. 5*a* and 5*b* illustrate the Fourier spectrum of voltage of the coil 104; FIGS. 5*c* and 5*d* show the displacement of the diaphragm 102; and FIGS. 5*e* and 5*f* illustrate the sound-pressure level detected by an external microphone (not shown). The response in absence of a stimulation is shown in black, and the response to stimulation at the two frequencies $f_1$ and $f_2$ is shown in grey. FIGS. 5*a* and 5*b* illustrates that stimulation at the two frequencies $f_1$ and $f_2$ evokes a coil response at the respective resonant frequency $f_0$ in both the microphones 110 and 120. FIG. 5*c* illustrates how the reciprocal active microphone 110 transmits the response at $f_0$ to the diaphragm 102, from which it is emitted as sound, as seen in FIG. 5*e*. This sound is the distortion. In contrast to the reciprocal active microphone 110, FIG. 5*d* illustrates that the signal at $f_0$ is decoupled from the diaphragm and therefore, no sound/distortion is emitted from the unidirectional active microphone 120, as seen in FIG. 5*f*.

EXAMPLES

The present invention will be understood more readily by reference to the following examples, which are provided by way of illustration and are not intended to be limiting in any way.

Example 1

Construction of a Unidirectional Active Microphone

Figure 6:
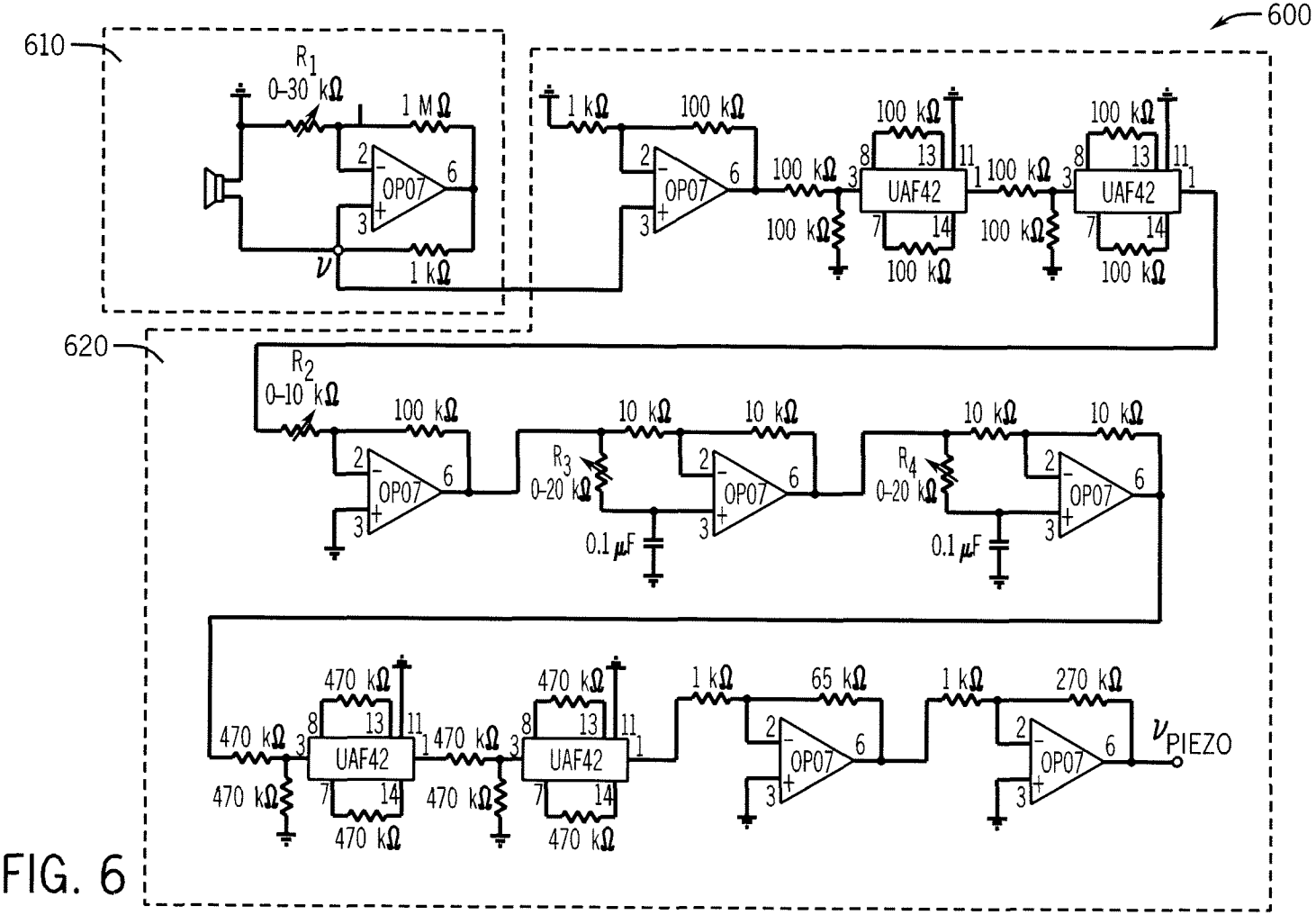
FIG. 6 illustrates a circuit used to provide amplification to the coil and to control the piezoelectric voltage according to an illustrative embodiment.

A 6.5-inch-diameter Soundstream speaker was modified by detaching the diaphragm from the voice coil and inserting between them a Thorlabs piezoelectric element which is 10 millimeter in length having a maximal voltage of 150V and capable of a displacement of 9.1 micrometers. The speaker's spider was modified to yield a smaller coil displacement per volt in the range of the piezoelectric element. FIG. 6 illustrates a circuit 600 used to provide mechanical amplification and adjustment of the piezoelectric element's voltage to different magnitude and phases. Circuit portion 610 provided electrical feedback to the voice coil and hence, mechanical amplification. The feedback gain could be adjusted by varying the resistance $R_1$. Circuit portion 620 converted the coil voltage V into a voltage $V_{piezo}$ that was fed into an amplifier of a maximal output voltage of 150V and a fixed gain of 10× to yield a piezo voltage $V_p$. The gain of the circuit portion 620 was controlled through the variable resistance $R_2$ and the circuit's phase was controlled through the variable resistances $R_3$ and $R_4$. To counteract high-frequency noise in the circuit, four two-pole low-pass filters were constructed using filters, Texas Instruments part UAF42. $V_p$ was connected to the piezoelectric element. To adjust unidirectionality the voice coil was driven with two additional piezoelectrical elements that were anchored in the speaker's wall and attached to the coil. Sounds were generated with Mathematica and presented through a 4-inch diameter Boss Audio Systems speaker. For distortion products two frequencies $f_1$ and $f_2$ were generated independently and presented through two distinct speakers.

It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable systems include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A unidirectional active microphone comprising:

a piezoelectric component;

a diaphragm operably coupled to a first side of the piezoelectric component;

a coil operably coupled to a second opposite side of the piezoelectric component and operably connected to the diaphragm, wherein a vibration of the diaphragm causes oscillation of the coil;

a circuit operably coupled to the coil and the piezoelectric component configured to provide mechanical amplification to the coil, wherein the circuit receives a voltage output from the coil, and wherein the circuit applies a voltage to the piezoelectric component thereby creating a unidirectional active microphone; and an elastic element operably coupled between the piezoelectric component and the diaphragm, wherein the voltage applied to the piezoelectric component breaks reciprocity between the diaphragm and the coil, and wherein the diaphragm and coil prevents distortion, based upon a linear combination of two or more input frequencies, of the diaphragm.

2. The unidirectional active microphone of claim 1, wherein the voltage applied to the piezoelectric component effectively decouples the diaphragm from the coil, wherein the diaphragm is uninfluenced by distortion in the coil.

3. The unidirectional active microphone of claim 2, wherein the piezoelectric component prevents amplification, based on the distortion in the coil, of the diaphragm.

4. The unidirectional active microphone of claim 3, wherein the unidirectional active microphone has a critical gain and the prevention of amplification of the diaphragm lowers the critical gain of the unidirectional active microphone.

5. The unidirectional active microphone of claim 1, wherein the length of the piezoelectric component is controlled by the voltage output from the coil.

6. The unidirectional active microphone of claim 5, wherein the circuit comprises a feedback portion, wherein the feedback portion amplifies the voltage output from the coil and feeds the amplified voltage back into the coil.

7. The unidirectional active microphone of claim 6, wherein the circuit further comprises an amplifier that amplifies the amplified voltage from the feedback portion to provide a piezoelectric voltage and provides the piezoelectric voltage to the piezoelectric component.

8. The unidirectional active microphone of claim 1, wherein the coil is displaced by an external sound force and an internal Lorentz force.

9. The unidirectional active microphone of claim 8, wherein the diaphragm is displaced by the external sound force but not the internal Lorentz force.

10. The unidirectional active microphone of claim 9, wherein the diaphragm has a structure that such that the diaphragm does not display a Hopf bifurcation at a critical gain.

11. A method comprising:

receiving a voltage from a coil, wherein the voltage is based upon a vibration of a diaphragm;

amplifying the voltage from the coil using an amplifier; and applying the amplified voltage to a piezoelectric component, wherein the piezoelectric component is connected to the coil and the diaphragm, wherein the piezoelectric component changes length based upon the amplified voltage, wherein the amplified voltage effectively decouples the diaphragm from the coil, wherein the diaphragm has a structure such that the diaphragm is uninfluenced by distortion in the coil, and wherein the decoupled diaphragm and coil prevents distortion, based upon a linear combination of two or more input frequencies, of the diaphragm.

12. The method of claim 11, wherein the piezoelectric component prevents amplification, based on distortions in the coil, of the diaphragm.

13. The method of claim 12, wherein the prevention of amplification of the diaphragm lowers a critical gain of the unidirectional active microphone.

14. The method of claim 11, wherein the coil is displaced by an external sound force and an internal Lorentz force.

15. The method of claim 14, wherein the diaphragm is displaced by the external sound force but not the internal Lorentz force.

16. The method of claim 15, wherein the diaphragm does not display a Hopf bifurcation at a critical gain.

* * * * *